United States Patent [19]

Rosenthal et al.

[11] Patent Number: 4,745,726

[45] Date of Patent: May 24, 1988

[54] CARRIAGE SAFETY AND CHAIN TENSIONING DEVICE FOR STRETCH WRAP MACHINES

[75] Inventors: Henry Rosenthal; Howard J. Hein, both of Boca Raton, Fla.

[73] Assignee: Mima, Inc., Pompano Beach, Fla.

[21] Appl. No.: 914,391

[22] Filed: Oct. 2, 1986

[51] Int. Cl.[4] ..... B65B 11/04

[52] U.S. Cl. ..... 53/77; 53/556; 53/587; 187/83

[58] Field of Search ..... 53/556, 587, 77; 187/82, 83

[56] References Cited

U.S. PATENT DOCUMENTS

| | | | |
|---|---|---|---|
| 579,797 | 3/1897 | Gray | 187/82 |
| 855,646 | 6/1907 | Lehn | 187/82 |
| 912,173 | 2/1909 | Rowley | 187/82 |
| 4,458,467 | 7/1984 | Shulman | 53/587 |
| 4,538,706 | 9/1985 | Koppensteiner | 187/83 X |

FOREIGN PATENT DOCUMENTS

| | | | |
|---|---|---|---|
| 403201 | 4/1966 | Australia | 187/83 |
| 23312 | of 1911 | United Kingdom | 187/82 |

*Primary Examiner*—John Sipos

*Attorney, Agent, or Firm*—Dressler, Goldsmith, Shore, Sutker & Milnamon, Ltd.

[57] ABSTRACT

Apparatus for vertically regulating the dispensing height of stretchable wrapping material for stretch wrapping a load which comprises carriage means for varying the height of the carriage means between predetermined upper and lower positions, and safety means to prevent the fall of the carriage means to the lower position in the event of a failure of the height varying means. Also, a methods for preventing the accidental downward movement or falling of the carriage means in the event of a failure of the height regulating means which comprises providing safety means to grasp the frame means of a stretch wrapping apparatus when the height varying means breaks or fails.

4 Claims, 3 Drawing Sheets

CARRIAGE SAFETY AND CHAIN TENSIONING DEVICE FOR STRETCH WRAP MACHINES

TECHNICAL FIELD

The present invention relates to a safety apparatus and method for preventing a vertically movable carriage from falling due to the failure of the height regulating mechanism of the carriage. This safety device also provides a visual monitor of chain tension. The invention particularly relates to the vertically movable carriage of a stretch wrapping machine which dispenses stretchable wrapping material to a load to be wrapped.

BACKGROUND ART

Plastic stretch wrapping machines are well known in the art and are covered by numerous patents regarding their structure and operation. An important feature of many of these machines relates to the vertical movement of the plastic film supply, so that large loads can be completely wrapped with stretchable plastic film. It is not uncommon to have the film supply travel to a height of as high as 120 inches. Since many of the machines which include this feature are semi-automatic, there is a great likelihood that an operator of the machine will be working nearby or under the carriage which holds the film supply during operation or temporary shutdown of the machine. For examples, the machine may be stopped temporarily to adjust the wrapping of the load or to replace a spent film supply roll.

This presents a significant safety problem because the carriage assembly can weigh between 40 and 300 pounds and on most occasions, rests at a significant height above the base when the operation of the wrapping apparatus is temporarily discontinued. In the event of a mechanical breakage of the height regulating mechanism (i.e., breakage of the elevating chain, or disconnection of the chain drive means from the drive sprocket or motor), the entire carriage assembly can come crashing down to the base of the unit. Thus, those working around the machine must be careful to avoid having this weight fall on their body, in particular their toes, fingers, or head.

While it is possible to design the stretch wrapping machine with gates or other safety mechanisms to prevent personnel from occupying the space beneath the film supply carriage, such safety devices encumber the proper operation of the machine and also make it much more difficult to easily obtain the required and necessary stretch wrapping of the load.

Therefore, the present invention provides a safety device and method for preventing falling of the carriage in the event of a failure of the height regulating mechanism.

SUMMARY OF THE INVENTION

The invention relates to an apparatus for vertically regulating the dispensing height of stretchable wrapping material for stretch wrapping a load which comprises carriage means, means for varying the height of the carriage means between predetermined upper and lower positions, and safety means to prevent the fall of the carriage means to a lower position in the event of a failure of the height varying means. The carriage means may include a supply of stretch wrapping material and means for prestretching the stretchable wrapping material.

The means for varying the vertical height of the carriage means preferably utilizes connecting means having one end attached to the carriage means and the other end attached to the safety means, frame means for extending the connecting means in a vertical position capable of achieving the predetermined upper and lower positions of the carriage means, and drive means operatively associated with the connecting means for regulating the vertical height of the carriage means between the upper and lower positions.

In a preferred embodiment, the safety means is mounted upon the carriage means and includes means to grasp the vertical frame means to prevent accidental downward movement or falling of the carriage. Also, the safety means may include preloaded biasing means, such as spring means capable of releasing force upon the failure of the height varying means. Since the connection means is usually chain means, belt means or cable means, the safety means should include means for monitoring the tension of the connection means to facilitate carriage movement. The frame means can include one or more idler means for engaging and facilitating movement of the connection means, since the system is driven by motor means. Also, the apparatus preferably includes means for adjusting the tension of the connection means.

The invention also relates to an improvement in a apparatus for vertically regulating the dispensing height of stretchable wrapping material for stretch wrapping a load where the apparatus comprises carriage means, frame means, and means for varying the vertical height of the carriage means. Thus, a method for preventing the accidental downward movement or falling of the carriage means in the event of a failure of the height varying means comprises providing the safety means which grasps the frame means when height varying means breaks or fails.

The method may further include providing the safety means with means for monitoring the tension of the height varying means, adjusting the tension of the height varying means to a predetermined value to allow optimal performance of the height varying means, preloading the safety means with an amount of force sufficient to rapidly move the safety means adjacent to the frame means for grasping thereon, mounting the safety means on the carriage means, and driving the height varying means by motor means. Adjusting the tension of the height varying means to the proper value assures long life of the components and will prevent accidents.

BRIEF DESCRIPTION OF THE DRAWINGS

The foregoing and other features and advantages of the present invention will become more apparent from the following description of the preferred embodiments illustrated by the accompanying drawings, wherein.

DETAIL DESCRIPTION OF THE PREFERRED EMBODIMENTS

The present invention relates to the safety device for preventing the drop of the carriage which contains the film supply and prestretching mechanism of a stretch wrapping machine from an elevated vertical position to the platform base where it possibly can hit or injure operators working nearby. Furthermore, since the carriage is not designed to withstand a drop from any significant height, the proper operation and functioning of the carriage can be seriously damaged in the event of such a fall.

Figure 1:
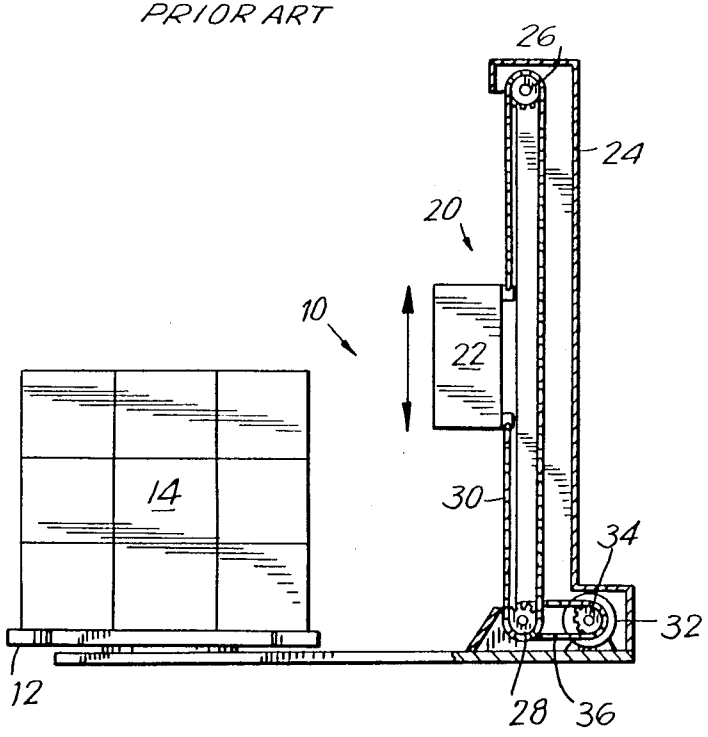
FIG. 1 PRIOR ART
FIG. 1 is a schematic view of a height regulating mechanism for a stretch wrapping machine according to the prior art.

As shown in FIG. 1, a known stretch wrapping machine 10 would typically include a turntable 12 for rotating a load 14 and a vertical height regulating mechanism 20. This mechanism 20 has carriage 22 capable of reciprocating vertical movement over the height of vertical frame 24 between idler sprocket 26 and drive sprocket 28 by a chain 30. One end of this chain is attached to the lower end of carriage 22 while the other end is attached to the upper end of carriage 22. Sprocket 28 is driven by motor 32, gear reducer and sprocket drive 34 and drive chain 36. As the load is rotated, carriage 22 is moved upwardly and downwardly over this vertical height so that the entire load is covered by wrapping material (not shown but see FIG. 3). A common wrapping material is plastic film which is prestretched to a predetermined amount before being wrapped around the load. Thus, the carriage can drop due to a failure of chains 30 or 36, motor 32 or disconnection of drive sprocket 34, with no mechanism for preventing the carriage from crashing down.

Figure 2:
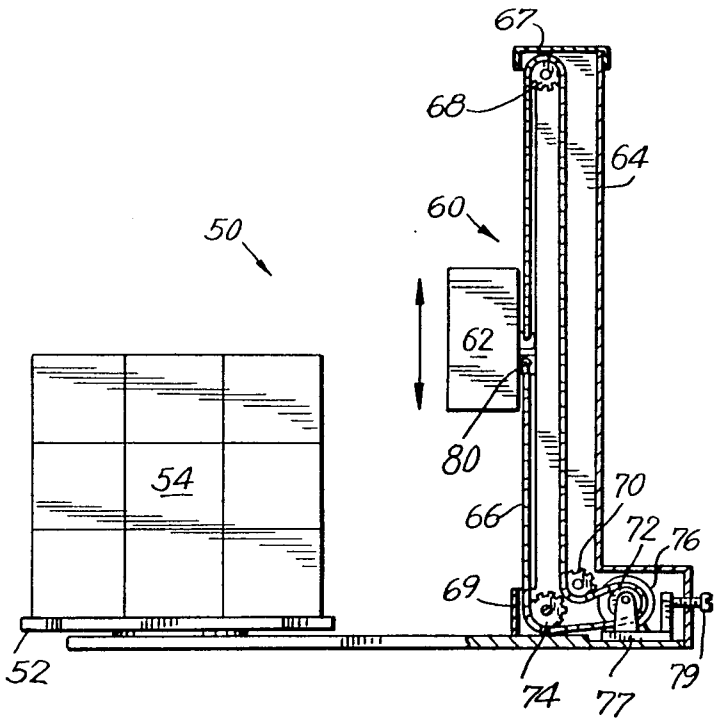
FIG. 2 is a schematic of the height regulating mechanism of a stretch wrapping apparatus according to the present invention.

FIG. 2 illustrates schematically an apparatus 50 according to the invention. Again, turntable 52 is used to support and rotate load 54. In this invention, however, the height regulating mechanism 60 is substantially improved as will be discussed hereinbelow. While this mechanism 60 includes a vertically movable carriage 62 and frame 64, the remaining components have been modified to achieve the advantages mentioned previously. Instead of utilizing two chains for imparting vertical movement to the carriage 60, a single chain 66, preferably in the form of a double link chain (AISI Type 40-2 or similar), is contemplated.

One end of this chain 66 is attached to the top portion of the carriage and then is directed around idler sprockets 68, 70, drive sprocket 72 and idler sprocket 74 before being connected to the bottom of carriage 62. Chain guards 67, 69 prevent operators from being caught between idler sprockets 68, 70, respectively, and frame 64. Sprocket 72 is attached to gear reducer and motor drive 76 which is used to move carriage 62 in conjunction with the rotation of the load 54 to achieve complete wrapping therearound. Gear reducer and motor drive 76 is mounted on a slidable plate 77 with adjustment screw 79 being provided for moving the slidable plate 77 to adjust the tension on chain 66.

Figure 4:
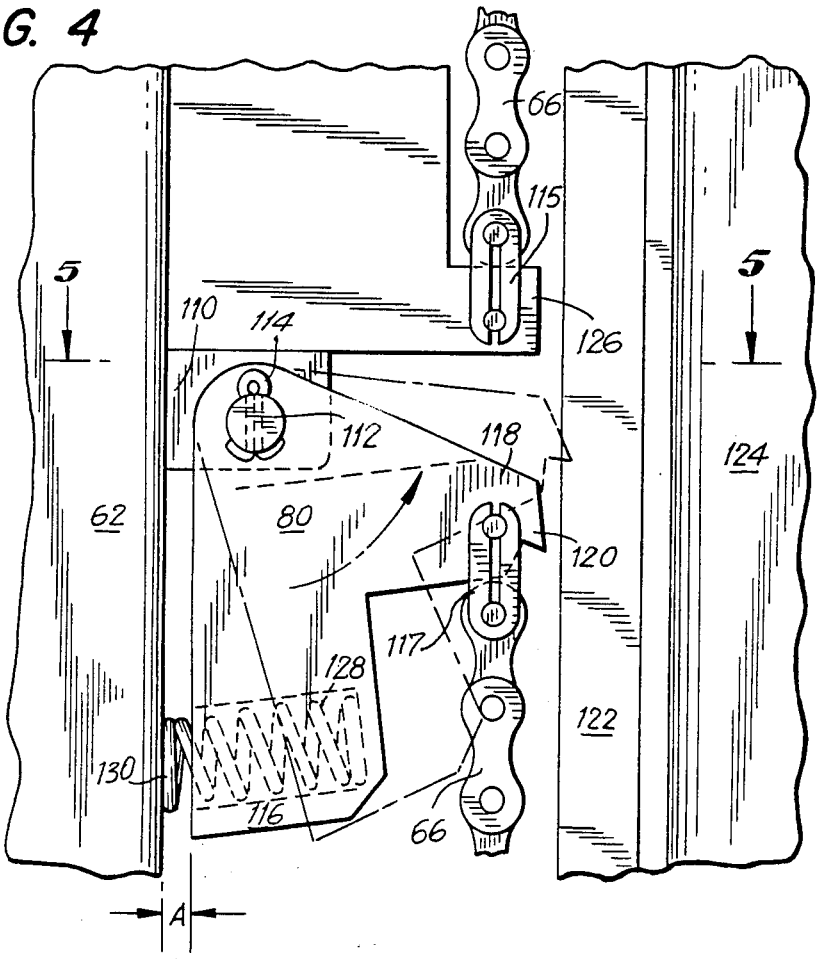
FIG. 4 is a detail of the safety mechanism of the present invention taken along lines 4—4 of FIG. 3 which also shows the tension adjusting gap.
Figure 5:
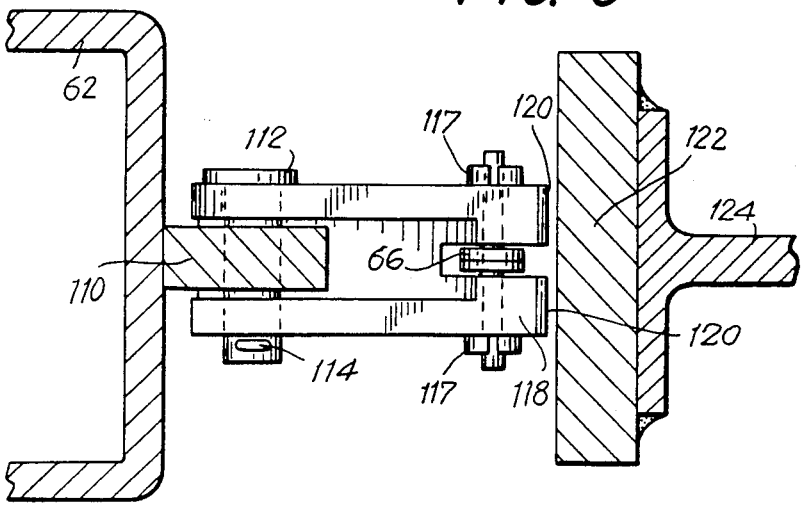
FIG. 5 is a view partially in cross-section taken along lines 5—5 of FIG. 4.

Chain 66 is connected to the bottom of carriage 62 by safety device 80. This device 80, which is described more fully hereinbelow in FIGS. 4 and 5, is used to prevent the accidental downward movement or falling of carriage 62 in the event of a mechanical failure of chain 66 or in the event that drive sprocket 72 breaks or becomes disengaged from the gear box or shaft of motor 76.

A further advantage of the safety device 80 is that it provides a visual check of chain tension to determine changes due to chain wear, motor 76 position, carriage 62 movement, etc. Since overtightening the tension of the chain can significantly decrease service life due to the imposition of excessive stresses on the chain, this visual monitor is extremely helpful. When deviations are noticed, chain tension can be adjusted to the proper range by rotating adjustment screw 79 in the appropriate direction. Therefore, in addition to increased service life, operating the chain with the proper tension reduces the chance of failure due to overstressing the chain, thus providing additional safety in the operation of the stretch wrapping apparatus.

Figure 3:
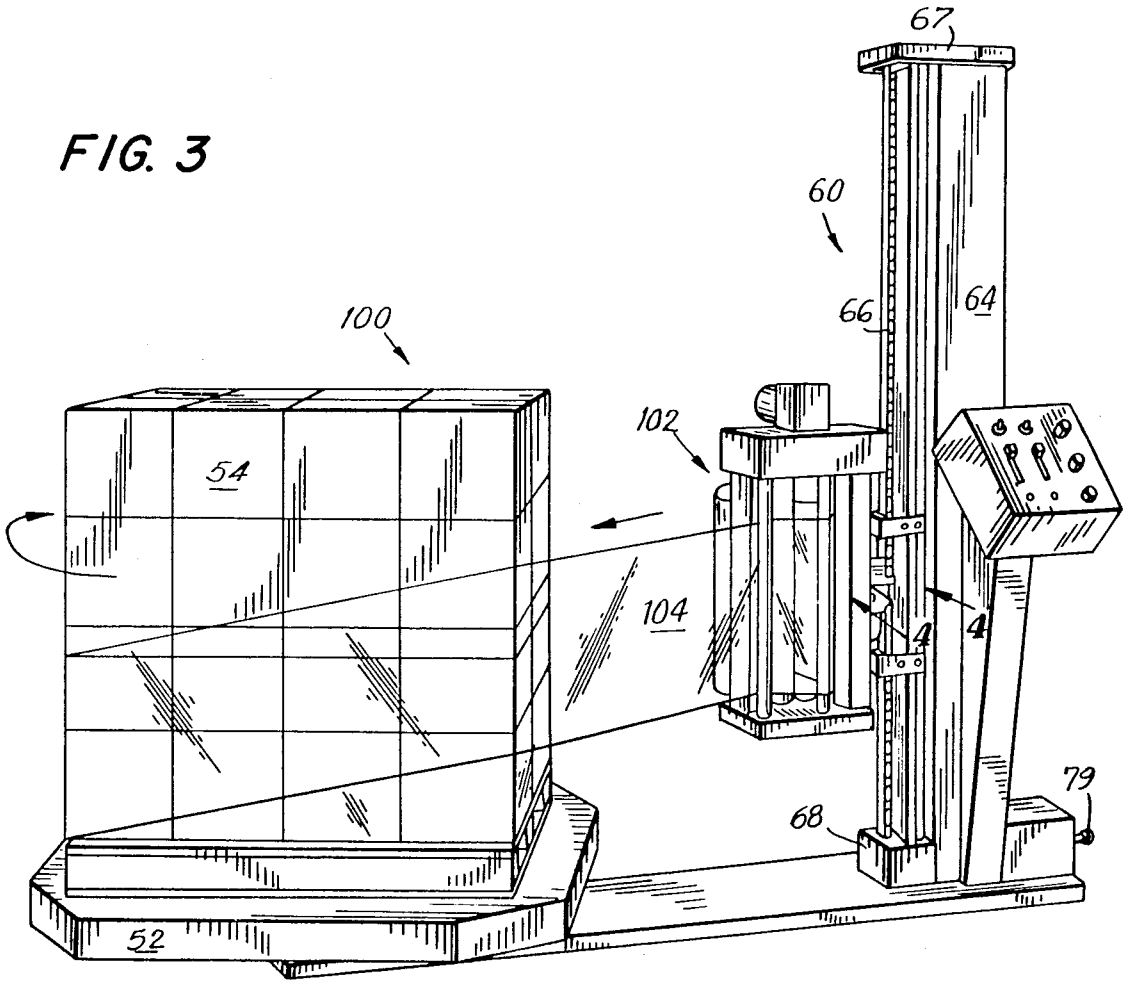
FIG. 3 is a perspective view of a stretch wrapping apparatus and height regulating mechanism according to the present invention.

The overall stretch wrapping apparatus 100 according to the invention is illustrated in FIG. 3. Where components identical to that of FIG. 2 are shown, the same numerical designation is used. In a preferred embodiment, carriage 62 includes a roller assembly 102 for prestretching plastic film 104 prior to wrapping the load 54. A supply of film is usually located on carriage 62 adjacent the roller assembly 102.

Rotation of the load 54 by turntable 52 is controlled by adjusting the appropriate controls of control box 106. This box 106 also controls the vertical height regulating mechanism 60 to operate in conjunction with the rotation of the load. Thus, operator input can be used to engage and discontinue the apparatus so that load 52 is completely and properly wrapped by film 104.

Referring now to FIGS. 4 and 5, the operation of safety device 80 is described and detailed. This device 80 includes a two-sided V-shaped member pivotally connected to carriage 62 at lug 110 by way of a pivot pin 112 and cotter pin 114 arrangement. Thus, the ends 116, 118 of safety device 80 are movable between a position where end 116 is in close proximity to carriage 62 to one where tip 120 of end 118 is in contact with strike plate 122. This strike plate is attached to frame 64 by support member 124.

One end of chain 66 is directly attached to the upper portion of carriage 62 at lug 126 by chain link end clip 115. As noted above, chain 66 is directed around various idler and drive sprockets. The opposite end of chain 66 is attached to end 118 of safety device 80 by chain link end clip 117. The tension on chain 66 is then adjusted to the appropriate value, which causes end 118 of safety device 80 to be pulled vertically downward and away from strike plate 122. End 116 of device 80 includes a recess 128 within which biasing spring 130 is situated. As end 118 is moved downwardly, end 116 is moved toward carriage 62, thus compressing spring 130. Spring 130 performs two important functions for safety device 80. First, spring 130 is preloaded and compressed so that it is capable of providing an actuating force which rapidly propels end 118 and tip 120 against strike plate 122 in the event of a failure as described above. By forming the tip 120 out of a harder material than plate 122, tip 120 will engage and grasp plate 122 when actuated by spring 130 in the event of any significant reduction of chain tension. The most dramatic reductions in chain tension would of course occur in the event of a failure as described above. A preferred material for tip 120 is hardened steel, with mild steel being the preferred material for the strike plate 122.

Spring 130 also prevents end 116 of safety device 80 from contacting carriage 62. During normal operation, therefore, this gap, shown as A in FIG. 4, can be visually monitored to determine chain tension. Proper chain tension would then correspond to a predetermined gap (e.g., ⅛"), and chain tension which is too great or too low would cause end 116 to be moved to a position where this gap is not at the proper dimension. When improper chain tension is detected (either visually or by more sophisticated detection systems), an adjustment can be made to the proper level by the adjustment screw 79 (shown in FIG. 2). As noted above, operating the chain at the proper levels (without overstressing the chain due to too much tension), allows increased chain and idler bearing life and a lower possibility of failure of the gear reducer shaft. Thus, this system provides greater reliability and a much safer environment for operators who must change the film supply or otherwise work near or under the carriage.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

What is claimed is:

1. A wrapping machine, of a type wherein wrapping material is dispensed from different heights, comprising:

frame means including a vertically extending plate;

a carriage mounted to the frame structure for upward and downward movement along said plate and adapted to carry wrapping material to be so dispensed;

a safety member mounted to the lower end of said carriage for pivotal movement within a limited range relative to the carriage, the safety member being adapted to prevent movement of the carriage downwardly along the vertically extending plate whenever the safety member engages said plate;

biasing means for biasing the safety member for upward pivotal movement tending to propel the safety member into engagement with said plate, opposite pivotal movement of the safety member loading the biasing means;

connection means having a first end portion attached to the upper end of said carriage and a second end portion attached to the safety member so that the safety member is pulled by the connection means, in a pivotal sense, so as to load the biasing means, which thus imparts tension to the connection means, and so that the carriage, the safety member, the biasing means, and the end portions of the connection means move together along the vertically extending plate; and means for driving the connection means for movement of the carriage, the safety member, the biasing means, and the end portions of the connection means along said plate;

whereby the biasing means propels the safety member into engagement with said plate to arrest movement of the carriage downwardly along said plate whenever the connection means becomes loosened sufficiently or broken.

2. The wrapping machine of claim 1 comprising means for adjusting the tension imparted by the biasing means to the connection means.

3. The wrapping machine of claim 1 wherein the connection means comprises a chain, which is entrained over a plurality of sprockets mounted rotatably in spaced positions relative to the frame means, the biasing means imparting tension to the chain.

4. The wrapping machine of claim 3 wherein one of the sprockets can be adjustably moved to different positions relative to the frame means for adjusting the tension imparted by the biasing means to the chain.

* * * * *